United States Patent [19]

Bühler

[11] Patent Number: 4,627,359

[45] Date of Patent: Dec. 9, 1986

[54] METHOD FOR THE RENEWAL OF A RAILROAD SWITCH OR CROSSING AND TRAIN FOR CARRYING OUT THE METHOD

[75] Inventor: Fritz Bühler, Ecublens, Switzerland

[73] Assignee: Les Fils d'Auguste Scheuchzer, S.A., Lausanne, Switzerland

[21] Appl. No.: 683,184

[22] Filed: Dec. 18, 1984

[30] Foreign Application Priority Data

Dec. 20, 1983 [CH] Switzerland ..... 6768/83

[51] Int. Cl.[4] ..... E01B 29/02

[52] U.S. Cl. ..... 104/3; 104/7.1; 105/215.1

[58] Field of Search ..... 104/2, 3, 7 R, 7 B; 105/215 R, 215 C

[56] References Cited

U.S. PATENT DOCUMENTS

| | | | |
|---|---|---|---|
| 1,994,717 | 3/1935 | Kopke et al. | 104/3 |
| 3,286,648 | 11/1966 | Brosnan | 104/2 |
| 3,797,401 | 3/1974 | Alimanestianu | 105/215 R X |
| 4,000,699 | 1/1977 | Scheuchzer et al. | 105/215 R X |
| 4,211,170 | 7/1980 | Theurer | 104/2 |

FOREIGN PATENT DOCUMENTS

| | | | |
|---|---|---|---|
| 108168 | 5/1984 | European Pat. Off. | 104/3 |
| 601243 | 8/1934 | Fed. Rep. of Germany | 104/2 |
| 2313055 | 9/1974 | Fed. Rep. of Germany | 104/3 |
| 1136284 | 5/1957 | France | 104/3 |

*Primary Examiner*—Robert B. Reeves
*Assistant Examiner*—David F. Hubbuch
*Attorney, Agent, or Firm*—Robert E. Burns; Emmanuel J. Lobato; Bruce L. Adams

[57] ABSTRACT

A train for carrying out the renewal of a railroad switch or crossing in a track comprises two chassis with a girder between them supported by two cranes on the respective chassis. Cross beams on the girder have hooks for gripping the switch or crossing. The girder is suspended from the cranes by rotary joints and an auxiliary winch has a cable connected to the switch or crossing off-center to provide for tilting the switch or crossing. At least one of the chassis is provided at its four corners with articulated arms and extensible columns provided with bogies for running on side rails. The arms can be swung in so that the bogies can run on standard gauge track.

9 Claims, 10 Drawing Figures

22
13
14
21
23
27

22
13
23
17
24
27
10
21
14
21

METHOD FOR THE RENEWAL OF A RAILROAD SWITCH OR CROSSING AND TRAIN FOR CARRYING OUT THE METHOD

FIELD OF INVENTION

The present invention concerns a method for the renewal of a railroad switch or crossing as well as a train for carrying out the method.

PRIOR ART

When renewing a railroad track, renewal of the railroad devices, for example switches or crossing, represents a quite considerable and relatively complicated job, for the railroad devices are very bulky components in respect of their width, and handling them poses problems. At the present time, the work of laying/removal and shifting of the railroad switches or crossings is carried out mainly in two ways.

(1) By cranes moving along the parallel track.

(2) By gantries running on a service track placed under the railroad switch or crossing which has been lifted beforehand.

In both cases, displacement of the switch or crossing is performed in a plane parallel to the plane of the track, and the track alignment gauge is exceeded considerably. Further, in the first case the cranes block the parallel track to traffic, and in the second case a large crew is needed to lay the service track under the lifted switch or crossing and to operate several gantries.

SUMMARY OF THE INVENTION

It is the object of the present invention to eliminate these disadvantages by proposing a method and a train for carrying out the method allowing a railroad switch or crossing or a part thereof to be laid or removed without blocking the parallel track to traffic by moving machines such as cranes along it, and offering the possibility of keeping within the track alignment gauge during displacement of the railroad switch or crossing which has been removed or is to be laid.

The method according to the invention is characterised by the fact that side rails are disposed on both sides of the railroad switch or crossing, said switch or crossing or a part thereof is raised by means of a girder suspended by its ends from two cranes, at least one of which is provided with means for running along the side rails and which are disposed on the ends of two track sections connected by said switch or crossing, the switch or crossing is moved to the site of dismounting, and the new railroad switch or crossing is supplied and laid by means of the girder and two cranes.

The advantages of the method which is the subject of the present invention are connected on the one hand with the fact that the cranes are located on the track containing the railraod switch or crossing, thus leaving the parallel track free for traffic, and on the other hand with the fact that the side rails which are installed on both sides of the railroad switch or crossing and the adjacent sections of the ordinary track facilitate renewal end ensure good stability on account of their gauge.

Preferably, according to one variant of the method, before transporting the lifted switch or crossing it is tilted about an axis at least approximately parallel to the longitudinal axis of the track in such a way that the track alignment gauge is observed and the parallel track or tracks are free for traffic.

Of course, the new switch or crossing is transported in the same way from the depot site to the site of laying.

According to one variant, after removal of the switch or crossing the side rails are joined together by spacer bars at normal gauge in order to allow cleansing of the ballast and/or road bed by maintenance machines known in the art.

The invention likewise concerns a train for carrying out the method characterized by the fact that it includes two cranes mounted on running gear suitable for running along the railroad, and a girder provided with gripping means for the railroad switch or crossing and suspended by its ends from the two cranes, and at least one of the cranes is provided with means for moving along side rails disposed on both sides of the railroad switch or crossing. Preferably, the two cranes are provided with means for tilting the lifted switch or crossing by rotating it about a longitudinal axis approximately parallel to the plane of the track.

According to one variant, the same means which are used for movement along the side rails and which are preferably supported orientable in the plane of the chassis and provided with bogies, are also provided with track lifters for laying side rails.

Apart from the above-mentioned advantages, the method and the train for carrying out the method also allow the number of persons in the crew entrusted with the operations of renewal of the railroad switch or crossing to be restricted to a minimum, most of the operations being performed by mechanical means.

Furthermore, the bogies for running along the side rails are also adaptable to run along the ordinary track, which allows stability of the cranes to be increased when transporting a railroad switch or crossing.

BRIEF DESCRIPTION OF THE DRAWINGS

The invention will be described in detail with the aid of attached drawings concerning a preferred embodiment of the invention.

DESCRIPTION OF THE PREFERRED EMBODIMENTS

Figure 1:
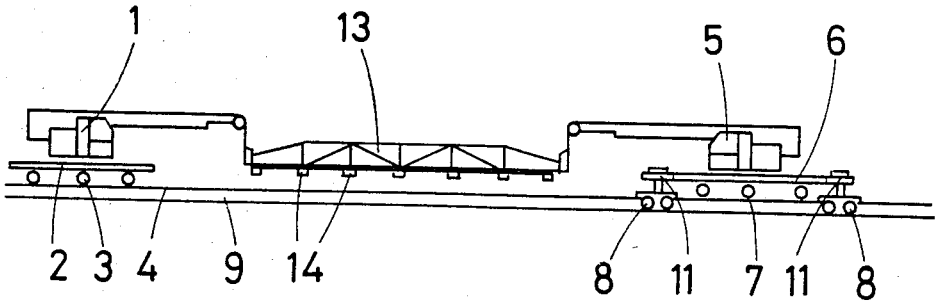
FIG. 1 is a schematic side view of a renewal train.
Figure 2:
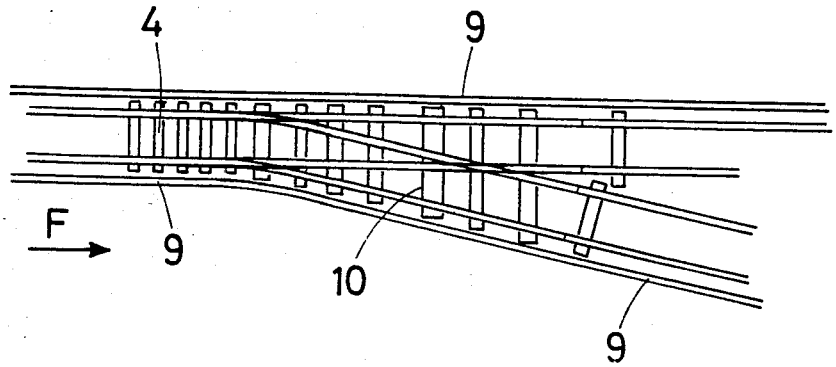
FIG. 2 is a plan view of a track with a switch or crossing and the side rails.

The renewal train illustrated in FIG. 1 includes a first crane 1 mounted on a chassis 2 provided with the gear 3 for running on the track 4, a second crane 5 mounted on a chassis 6 and provided firstly with gear 7 for running on the track 4 and secondly with bogies 8 for running on the side rails 9, and lastly a girder 13 suspended by its ends from the two cranes 1 and 5. The side rails 9 are disposed on both sides of the switch or crossing 10 and adjacent sections of the track 4, that is, those connected by the switch or crossing 10 (FIG. 2). The bogies 8 are fixed to the ends of supports 11 articulated to the chassis 6 of the crane 5. The girder 13 is provided with gripping means 14 in the form of lifting beams for gripping the switch or crossing 10 to be lifted.

Figure 3:
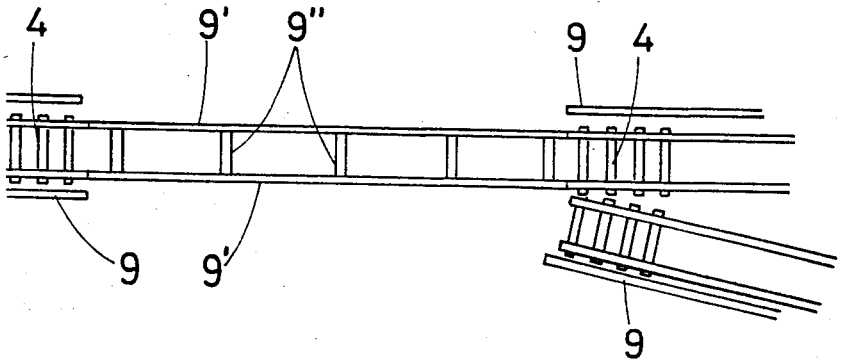
FIG. 3 is a view similar to the preceding one, with the switch or crossing removed and the side rails assembled at normal gauge.

FIG. 3 shows the track 4 without the switch or crossing 10, and the side rails 9 at the site of the switch or crossing being shifted to normal gauge 9' and joined together by spacer bars 9'' to ensure continuity of the track and allow cleansing of the ballast and/or road bed by known machines.

Figure 4:
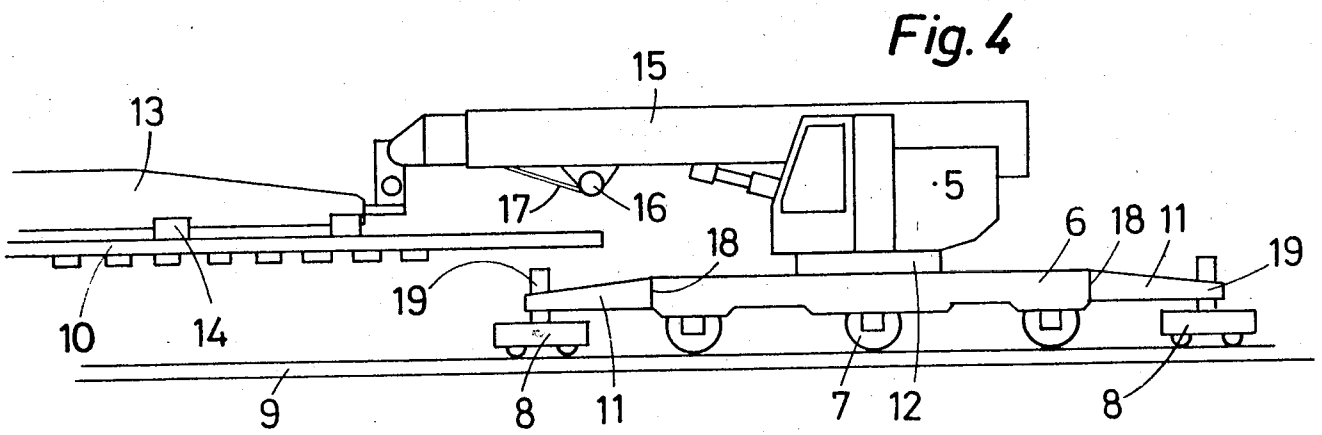
FIG. 4 is a side view showing in greater detail the crane provided with the means for moving along the side rails and part of the girder.
Figure 5:
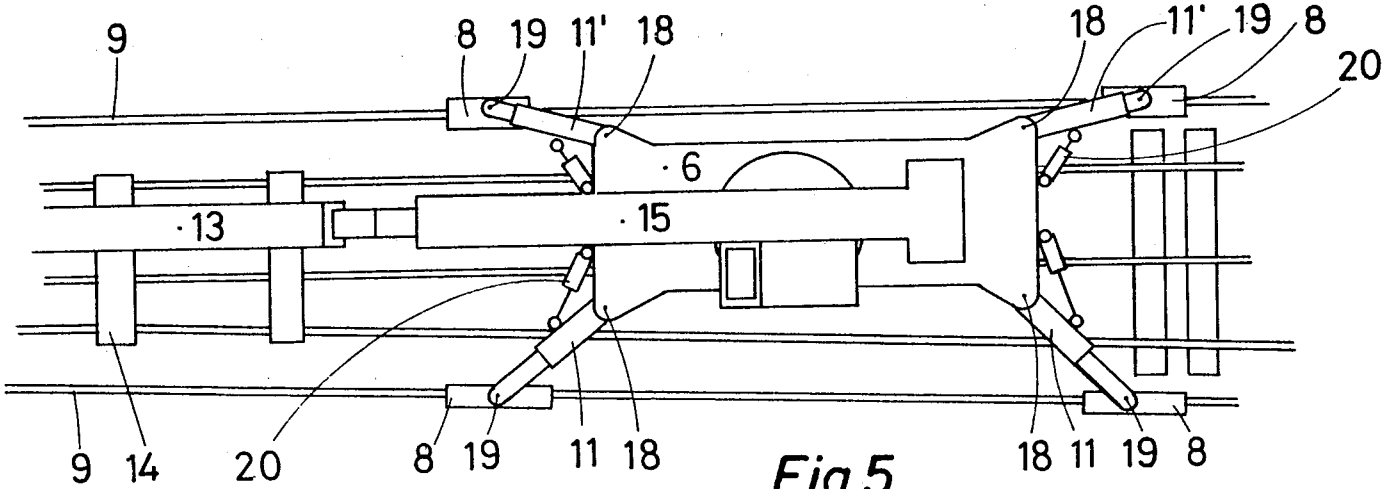
FIG. 5 is a plan view of the preceding figure.

The cranes 1 and 5 are each provided with a telescopic jib 15 equipped with an auxiliary winch 16 and a cable 17, as shown only for crane 5 (FIGS. 4 and 5), allowing tilting of the lifted switch of crossing as will be described below. The crane 1 or 5 is mounted on a 360° turntable 12. At least one of the two sets of running gear 3 and 7 is provided with drive means to allow movement of the train along the track 4.

In the example under consideration, only crane 5 is intended and equipped to run on the side rails 9 and will therefore be described in detail.

Figure 7:
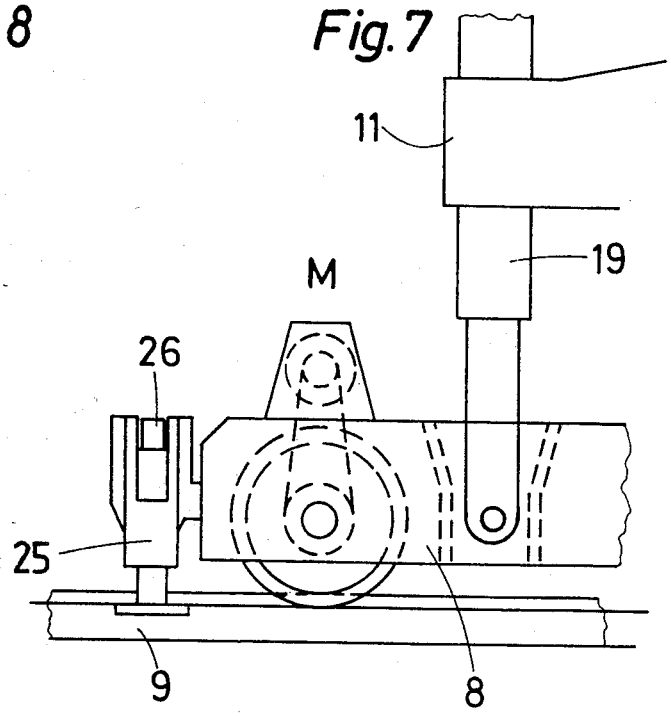
FIG. 7 is a side view of part of one of the bogies of one of the supports.

The chassis 6 of the crane 5 is provided at its ends with four supports 11 and 11' articulated to the chassis 6 by spindles 18 perpendicular to the plane of the chassis 6. The angular position of the supports 11, 11' in the plane of the chassis 6 is provided by hydraulic actuators 20 (FIG. 5), one actuator 20 being provided per support. From the free ends of the four supports 11, 11' are suspended by actuators 19, bogies 8 suitable for running on the side rails 9, at least one of these bogies being provided with drive means M (FIG. 7).

When the crane 5 moves along the side rails 9, the supports 11 and 11' are opened out, the bogies 8 come into contact with the side rails 9 by means of suspension-type actuators 19 simultaneously allowing lifting, if necessary, of the running gear 7 relative to the track 4. Basically, a pair of supports located on the same lateral side of the chassis 6, for example 11', are locked in a set angular position, while the other pair 11 remains free in order to be able to follow the variations in gauge of the side rails 9, particularly at the location of the switch or crossing 10.

Figure 6:
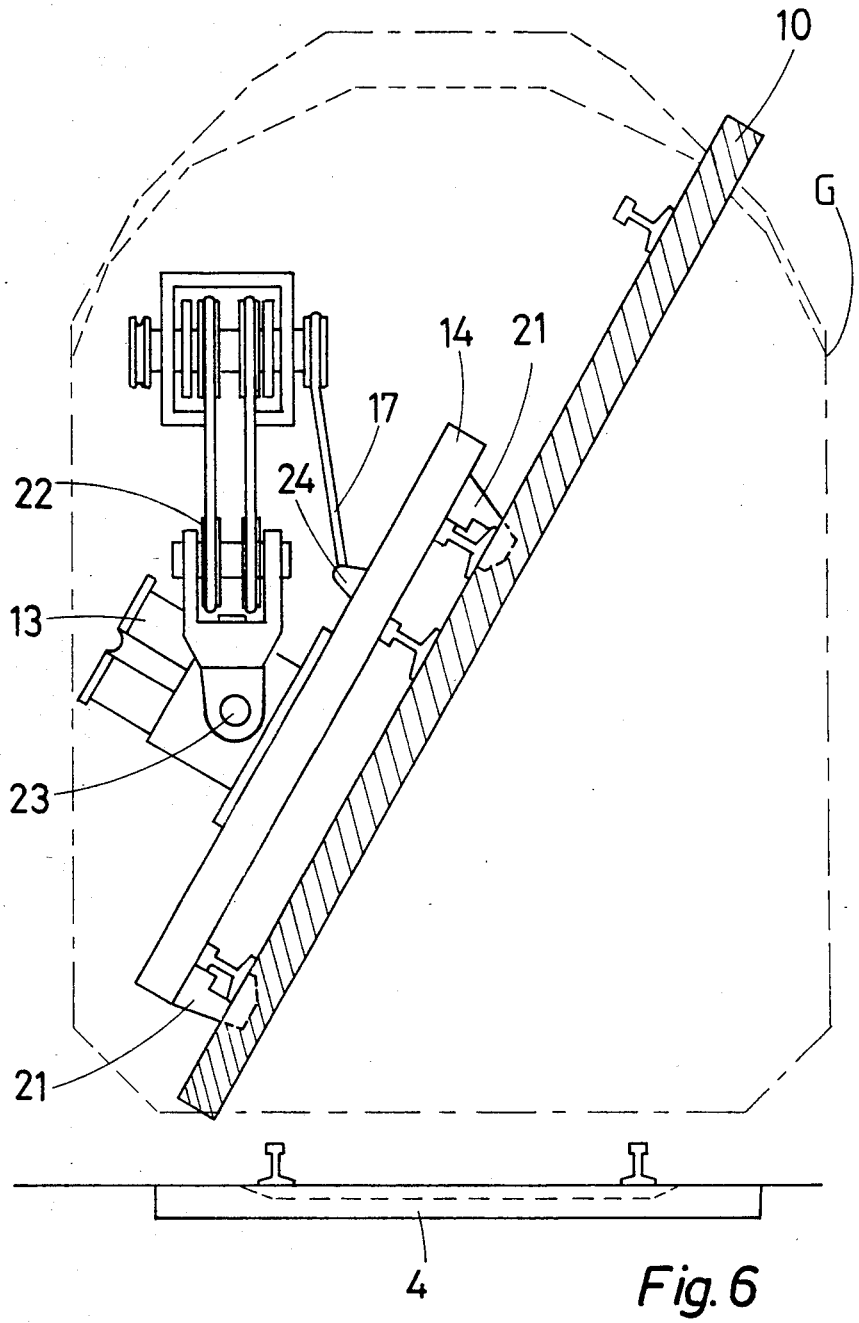
FIG. 6 is a view parallel to the axis of the track, showing a lifted and tilted switch or crossing.
Figures 9, 10:
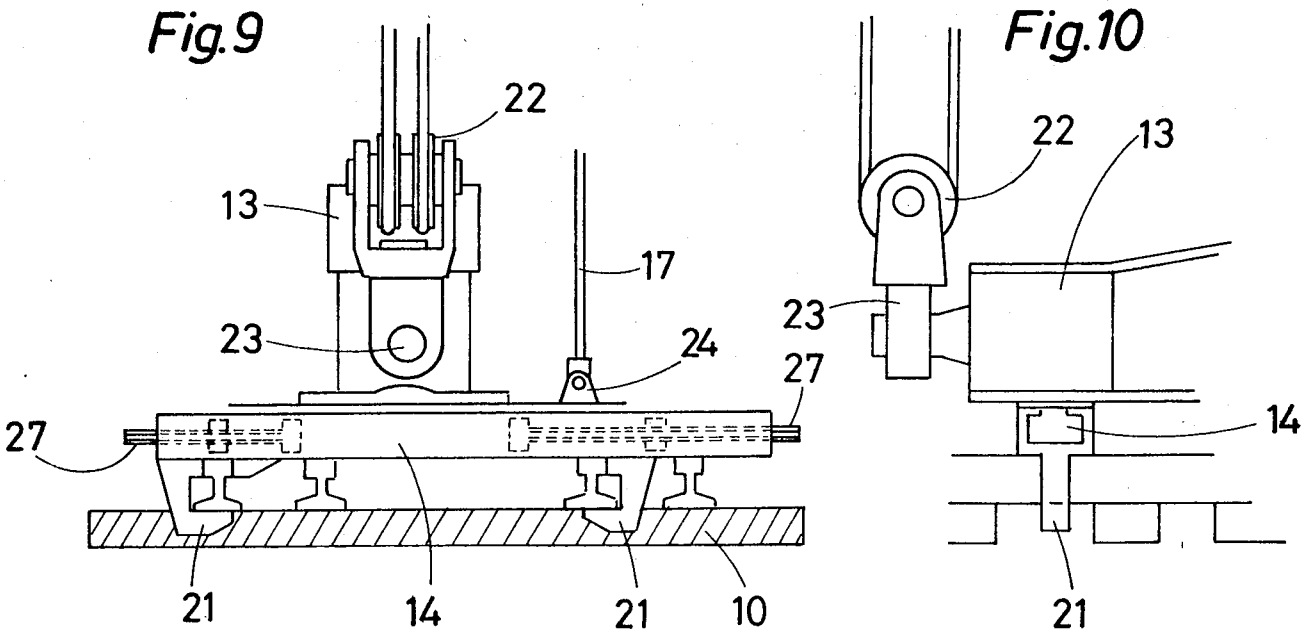
FIG. 9 shows from the front the girder and the means for gripping the switch or crossing.
FIG. 10 is a side view of the view according to FIG. 9.

The gripping means 14 of the girder 13 formed by lifting beams are provided with hooks 21 for gripping the switch or crossing 10, as shown in FIGS. 6, 9 and 10. In FIG. 6 is shown a railraod switch or crossing 10 lifted and tilted in such a way that it remains within the track alignment gauge G.

The girder 13 is suspended from the loose pulleys 22 of the cranes 1 and 5 by joints 23 (FIGS. 9 and 10) allowing tilting of the girder 13 about an axis parallel to the plane of the track 4. Tilting is obtained by the action of the cable 17 of each crane 1, 5 attached to a point 24 of a lifting beam 14, offset from the axis defined by the two suspension joints 23 of the girder 13, and driven by the auxiliary winch 16. This same cable 17 allows, during lifting of the switch or crossing 10, balancing of the load in a plane approximately parallel to that of the track 4.

In order to avoid deformation of the switch or crossing 10, several extensible lifting beams 14 are provided, with adjustable width for adaptation to the gauge of two non-parallel rails. The hooks 21 (FIG. 9) are positioned at the desired gauge by worms 27, to allow gripping of the switch or crossing 10 or the release thereof.

Figure 8:
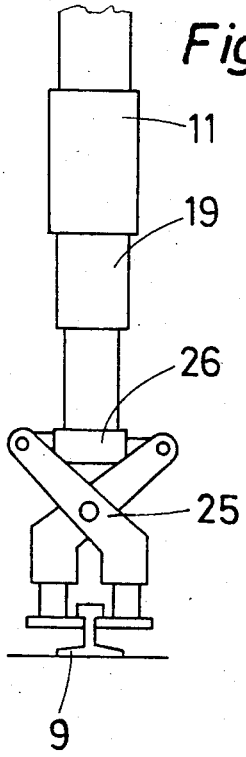
FIG. 8 is a front view of the part shown in the preceding figure.

To allow laying of side rails 9 (FIGS. 7 and 8) the bogies 8 of the supports 11, 11' are provided with track lifters 25 driven by a double-acting cylinder 26. These lifters allow laying of the side rails on both sides of the railroad track as well the removal thereof on completion of the work.

In FIG. 7 is shown a bogie 8 provided with a motor M ensuring drive of the crane over the side rails 9.

Operation of the train according to the method is as follows: the train arrives along the track 4 at the site of the switch or crossing 10, laying the side rails 9 on both sides as it proceeds. In the example illustrated in FIG. 2, the train approaches from the left (in the direction of the arrow F), and during this time the two cranes 1 and 5 run over the ordinary track 4. When the girder 13 is above the railraod switch or crossing 10, the bogies 8 are lowered by the suspension type actuators 19 so that they are supported on the side rails 9 and so as to lift simultaneously the chasis 6 with its running gear 7; then the switch or crossing 10 is dismounted from the rest of the track 4, raised with the girder 13 and two cranes (FIGS. 4 and 5), and tilted by means of the winches 16 (FIG. 6). The train leaves in the direction in which it arrived (to the left in FIG. 2) and the crane 5 traverses the region of the switch or crossing which has been removed by running exclusively along the side rails 9 by means of supports 11, 11' provided with bogies 8 until the region from which the switch or crossing 10 has been removed has been crossed, then the crane 5 can be lowered in such a way that its running gear 7 is in contact with the ordinary track 4, and the supports 11, 11' and bogies 8 return to their rest position. The supension-type actuators 19 allow accommodation of the variations in height of the service track formed by the side rails.

In theory, the switch or crossing 10 can be dismounted or lifted while the crane 5 is resting on the ordinary track 4 by its running gear 7, and after the switch or crossing 10 has been lifted and is ready to be transported the bogies 8 are placed in contact with the side rails 9. Naturally, if this last operation is performed before dismounting of the switch or crossing 10, it allows the stability of the crane 5 to be increased.

The new switch or crossing is supplied to the site of the old one in the opposite direction and by the reverse operations. In the meantime, the ballast and/or road bed has been cleansed by maintenance machines known in the art. To do this, the side rails 9 can be joined together (FIG. 3) at normal gauge 9' to allow movement of the cleansing machines. After the cleansing work, the side rails 9 are moved apart to allow the train with the new switch or crossing 10 to travel over the region from which the switch or crossing has been removed, by means of supports 11, 11' and bogies 8, and to stop above said region. In fact, since it is genrally prohibited, for obvious reasons of safety, to work under the suspended switch or crossing 10, the side rails 9' ought to have been moved apart before the arrival of the new switch or crossing 10, so the service track cannot be used at normal gauge 9' to allow traversing of the region from which the switch or crossing 10 has been removed.

Of course, the other crane 1 or both cranes 1 and 5 may be provided with supports 11, 11' to carry out this work.

If both cranes 1, 5 of the train are provided with means 8, 11, 11' for moving along the side rails 9, the arrival and departure of the train may take place in any direction. On the other hand, if only one crane is provided with these means, as in the embodiment described above, departure of the train with the swtich or crossing 10 must take place in such a way that the crane 1, which is not equipped to run along the side rails 9, is at the front, for it cannot traverse the track region in which was located the lifted switch or crossing 10.

Obviously, if the switch or crossing 10 is very long, it can be removed and the new one supplied by dismantling it into two or more parts. In this case, it is necessary for both cranes 1,5 to be adapted to run along the side rails 9 in order to be able first of all to remove all the parts of the switch or crossing 10 before supplying the parts of the new switch or crossing, for in this case the distance between the two cranes 1 and 5 is less than the total length of the switch or crossing 10.

To allow the stability of the train to be increased when moving along the ordinary track with the lifted switch or crossing, the bogies 8 may be constructed in such a way that they can also run on the rails of the ordinary track 4. For this, the angle of the supports 11, 11' is modified by the actuators 20 in such a way that the bogies 8 are perpendicular to the rails of the track 4, and by the suspension-type actuators 19 they are lowered onto the rails of the ordinary track 4.

What is claimed is:

1. A train for carrying out the renewal of a switch or crossing in a track, comprising first and second chassis, each having running gear comprising bogies for running on standard gauge track, said two chassis being spaced apart from one another a distance greater than the track-wise extent of a switch or crossing to be renewed, a girder disposed between said chassis and extending lengthwise of the track, a first crane on said first chassis supporting a first end of said girder, a second crane on said second chassis supporting a second end of said girder, and means on said girder for gripping a switch or crossing to be renewed, support means on at least one of said chassis for running along side rails disposed on both sides of said switch or crossing, said means for running on said side rails being also adaptable for running on standard gauge track when transporting a railroad switch or crossing to increase the stability of the crane on said chassis during such transport.

2. A train according to claim 1, further comprising means for driving said means for running on said side rails.

3. A train according to claim 1, in which said support means is provided with means for laying and for removing side rails.

4. A train according to claim 3, in which said means for laying and for removing side rails comprises at least one pair of track lifters and power means for actuating said track lifter.

5. A train for carrying out the renewal of a railroad switch or crossing in a track comprising first and second chassis, each having running gear comprising bogies for running on standard gauge track, said two chassis being spaced apart from one another a distance greater than the track-wise extent of a switch or crossing to be renewed, a girder disposed between said chassis and extending length-wise of the track, a first crane on said first chassis supporting a first end of said girder, a second crane on said second chassis supporting a second end of said girder, and means on said girder for gripping a switch or crossing to be renewed,at least one of said chassis having at each of four corners thereof support means for running on a side rail, each of said support means comprising a support arm articulated on said chassis for swinging about a vertical axis, a vertically extensible support column at an outboard end of said support arm and an auxiliary bogie on a lower end of said support column, power means controlling the angular position of said support arm with respect to the chassis and power means controlling the effective length of said support column between said support arm and said auxiliary bogie, whereby said support arms are swingable about their axes to vary the distance of said support column from the longitudinal center line of said chassis and said support columns are extensible to support said chassis by said auxiliary bogies running on said side rails.

6. A train according to claim 5 further comprising means for driving at least one of said auxiliary bogies.

7. A train for carrying out the renewal of a switch or crossing in a track, comprising first and second chassis each having running gear comprising bogies for running on standard gauge track said two chassis being spaced apart from one another a distance greater than the track-wise extent of a switch or crossing to be renewed, a girder disposed between said chassis and extending lengthwise of the track, a first crane on said first chassis for supporting a first end of said girder, a second crane on said second chassis for supporting a second end of said girder, means on said girder for gripping a switch or crossing to be renewed, said girder being suspended from said two cranes by suspension joints allowing it to rotate about its longitudinal axis, at least one of said cranes being provided with an auxiliary winch switch having a hoisting cable for connection to said switch or crossing at a point outside a line connecting said two suspension joints of the girder to effect tilting of said switch or crossing about an axis defined by said two suspension joints of said girder.

8. Train according to claim 7, in which said gripping means comprises transversely extending beams on said girder, said beams being extensible, and hooks on said beams for gripping said switch or crossing.

9. Train according to claim 7, in which said gripping means comprises transversely extending beams on said girder, hooks on said beams for gripping said switch or crossing, said hooks being movable longitudinally of said beams and means for moving said hooks longitudinally of said beams and securing them in selected position.

* * * * *